US007412991B2

(12) United States Patent
Takimoto et al.

(10) Patent No.: US 7,412,991 B2
(45) Date of Patent: Aug. 19, 2008

(54) INDUSTRIAL TWO-LAYER FABRIC

(75) Inventors: Keiichi Takimoto, Shizuoka (JP); Ikuo Ueda, Shizuoka (JP); Masakazu Murakami, Shizuoka (JP)

(73) Assignee: Nippon Filcon Co., Ltd., Tokyo (JP)

( * ) Notice: Subject to any disclaimer, the term of this patent is extended or adjusted under 35 U.S.C. 154(b) by 293 days.

(21) Appl. No.: 11/270,595

(22) Filed: Nov. 10, 2005

(65) Prior Publication Data

US 2006/0112999 A1 Jun. 1, 2006

(30) Foreign Application Priority Data

Nov. 26, 2004 (JP) ..... 2004-341627

(51) Int. Cl.
*D21F 7/08* (2006.01)
*D03D 25/00* (2006.01)

(52) U.S. Cl. ..... 139/383 A; 139/384 R; 139/410; 442/205; 162/358.2

(58) Field of Classification Search ..... 139/383 A, 139/384 R, 408, 410, 383 R; 442/203, 205; 162/358.2, 900, 901, 903
See application file for complete search history.

(56) References Cited

U.S. PATENT DOCUMENTS 4,501,303 A * 2/1985 Osterberg ..... 139/425 A
4,729,412 A * 3/1988 Bugge ..... 139/383 A
4,815,499 A * 3/1989 Johnson ..... 139/383 A
4,945,952 A * 8/1990 Vohringer ..... 139/383 A
5,052,448 A * 10/1991 Givin ..... 139/383 A
5,092,372 A * 3/1992 Fitzka et al. ..... 139/383 A
5,454,405 A * 10/1995 Hawes ..... 139/383 A
5,544,678 A * 8/1996 Barrett ..... 139/383 A
5,564,475 A * 10/1996 Wright ..... 139/383 A
5,709,250 A * 1/1998 Ward et al. ..... 139/383 A
5,826,627 A * 10/1998 Seabrook et al. ..... 139/383 A
5,881,764 A * 3/1999 Ward ..... 139/383 A
6,581,645 B1 6/2003 Johnson et al.

(Continued)

FOREIGN PATENT DOCUMENTS

EP 1630271 A2 3/2006

(Continued)

OTHER PUBLICATIONS

European Search Report of Apr. 7, 2006.

*Primary Examiner*—Bobby H Muromoto, Jr.
(74) *Attorney, Agent, or Firm*—Rader, Fishman & Grauer, PLLC

(57) ABSTRACT

In an industrial two-layer fabric, either one of an upper side binding yarn and a lower surface binding yarn constituting a pair to be woven with an upper surface weft and a lower side weft passes under one lower surface weft and then passes over a plurality of lower surface wefts. A warp on one adjacent side of the one of the upper and lower surface binding yarns has a similar design thereto and passes over and under the same lower surface wefts. The design of a set of the two warps adjacent to each other is shifted and arranged one after another to form a complete design of the lower surface fabric and a lower surface weft has a design in which the weft passes over two successive warps and then passes under a plurality of warps to form a long crimp on the lower surface.

14 Claims, 15 Drawing Sheets

U.S. PATENT DOCUMENTS

| | | | | |
|---|---|---|---|---|
| 6,810,917 | B2 * | 11/2004 | Stone | 139/383 A |
| 6,860,299 | B2 | 3/2005 | Kuji | |
| 6,883,556 | B2 * | 4/2005 | Fahrer et al. | 139/383 A |
| 6,896,009 | B2 * | 5/2005 | Ward | 139/383 A |
| 6,920,902 | B2 * | 7/2005 | Majaury et al. | 139/383 A |
| 6,959,737 | B2 * | 11/2005 | Ward | 139/383 A |
| 6,978,809 | B2 * | 12/2005 | Quigley | 139/383 A |
| 6,989,079 | B2 * | 1/2006 | Johnson et al. | 162/348 |
| 7,008,512 | B2 * | 3/2006 | Rougvie et al. | 162/348 |
| 7,059,359 | B2 * | 6/2006 | Quigley et al. | 139/383 A |
| 7,108,020 | B2 * | 9/2006 | Stone | 139/383 A |
| 7,114,529 | B2 * | 10/2006 | Johnson et al. | 139/383 A |
| 7,124,781 | B2 * | 10/2006 | Fahrer et al. | 139/383 A |
| 7,195,040 | B2 * | 3/2007 | Ward | 139/383 A |
| 7,219,701 | B2 * | 5/2007 | Ward | 139/383 A |
| 7,243,687 | B2 * | 7/2007 | Barratte | 139/383 A |
| 7,275,566 | B2 * | 10/2007 | Ward | 139/383 A |
| 2003/0010393 | A1 | 1/2003 | Kuji | |
| 2004/0079434 | A1 | 4/2004 | Martin et al. | |

FOREIGN PATENT DOCUMENTS

| | | | |
|---|---|---|---|
| NO | 304193 | B1 | 2/1996 |
| NO | 317618 | B1 | 1/2002 |
| WO | WO-2004/038094 | A1 | 5/2004 |

* cited by examiner

1

2

1 2

1

2

FIG. 25
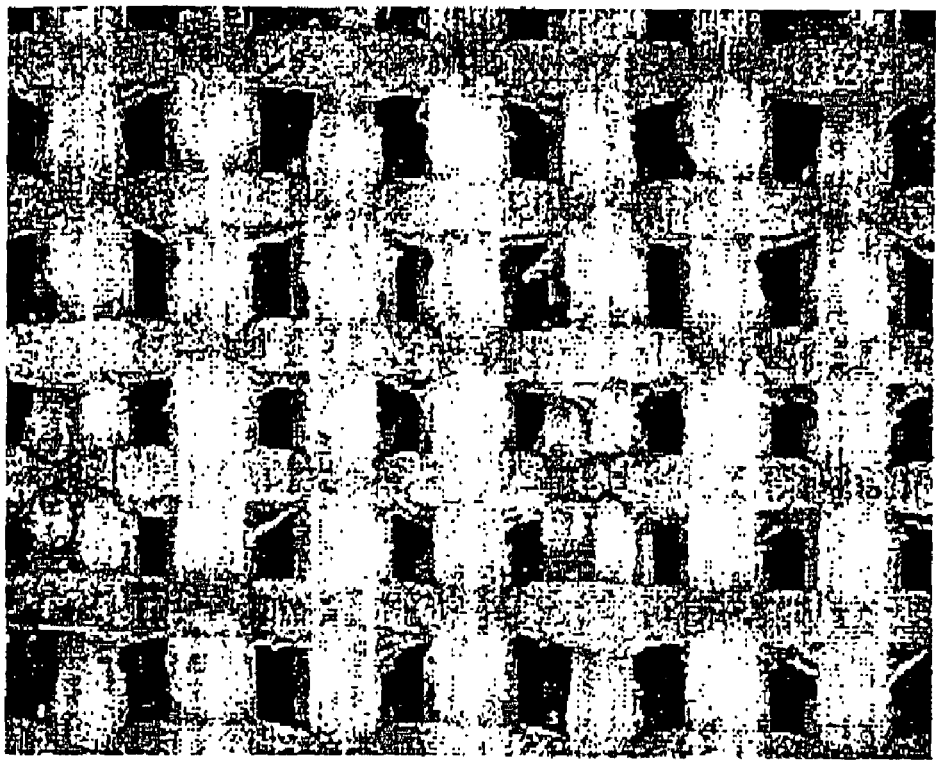
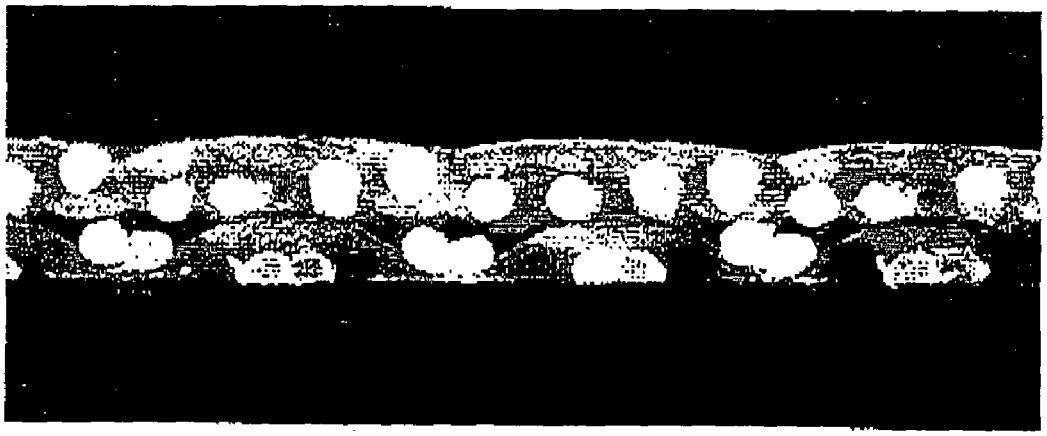
FIG. 26

INDUSTRIAL TWO-LAYER FABRIC

TECHNICAL FIELD OF THE INVENTION

The present invention relates to an industrial two-layer fabric using a warp binding yarn, which can satisfy the physical properties necessary for industrial fabrics such as wear resistance, surface property, rigidity, running stability and water drainage property.

BACKGROUND OF THE INVENTION

Fabrics obtained by weaving warps and wefts have conventionally been used widely as an industrial fabric. They are, for example, used in various fields including papermaking wires, conveyor belts and filter cloths and are required to have fabric properties suited for the intended use or using environment. Of such fabrics, a papermaking wire used in a papermaking step for removing water from raw materials by making use of the network of the fabric must satisfy a severe demand. There is therefore a demand for the development of fabrics which do not transfer a wire mark of the fabric and therefore have excellent surface property, have enough wear resistance and rigidity and therefore are usable desirably even under severe environments, and are capable of maintaining conditions necessary for making good paper for a prolonged period of time. In addition, fiber supporting property, improvement in a papermaking yield, good water drainage property, dimensional stability and running stability are demanded. In recent years, owing to the speed-up of a papermaking machine, requirements for papermaking wires become severe further.

Since most of the demands for industrial fabrics and solutions thereof can be understood if papermaking fabrics on which the most severe demand is imposed among industrial fabrics will be described, the present invention will hereinafter be described by using a papermaking fabric as a representative example.

For papermaking fabrics, excellent surface property not permitting transfer of wire marks of the fabric to paper, fiber supporting property for supporting fine fibers, wear resistance enough to permit long-period running even under severe running conditions, running stability ensuring stable running until the final using stage and rigidity are very important. Research on the design or constitution of the fabric capable of satisfying the above-described properties is proceeding. Recently, two-layer fabrics using, as a portion of upper surface side warps and lower surface side warps which are vertically arranged pairs, a warp binding yarn which is woven with both an upper surface side weft and a lower surface side weft to form an upper surface side surface and a lower surface side surface and at the same time, has a binding function have come to be used. A two-layer fabric using a warp binding yarn is also disclosed in Japanese Patent Laid-Open Publication No. 2003-342889. This fabric has excellent surface property, because it uses a warp binding yarn and does not use an additional binding yarn which destroys the upper surface side fabric design. In the fabric disclosed in this document, however, a lower surface side weft constituting a lower surface side fabric has a design in which it passes over two warps and then passes under two warps so that no long crimp of the lower surface side weft is formed on the lower surface side surface and the fabric does not have excellent wear resistance. In general, a fabric has improved wear resistance when a lower surface side weft is imparted with a long crimp design. In a fabric using a warp binding yarn, the fabric design is sometimes limited, depending on the yarn diameter, structure or using purpose of the fabric, or the like. For example, the fabric disclosed in Japanese Patent Laid-Open Publication No. 2003-342889 has a design, on the lower surface side fabric, in which a lower surface side weft passes over two warps and then passes under two warps. In this fabric, a water drainage space is formed between a set of lower surface side warps which are adjacent to each other.

SUMMARY OF THE INVENTION

By forming this fabric with yarns of a small diameter, it has a small thickness and becomes suited for manufacture of tissue paper, but not suited for applications requiring wear resistance and rigidity. Even if a lower surface side weft having a large diameter is used for a fabric of such a design, it is not flexible so that a warp protrudes from the lower surface side surface and is easily worn away.

Thus, in industrial fabrics using a warp binding yarn, those capable of satisfying all of the wear resistance, surface property, rigidity, running stability and water drainage property have not yet been developed.

An object of the present invention is to provide an industrial two-layer fabric capable of satisfying all the properties required for industrial fabrics such as surface property, wear resistance, rigidity, running stability and water drainage property.

In the present invention relates to a industrial two-layer fabric which comprises an upper surface side fabric having an upper surface side warp and an upper surface side weft and a lower surface side fabric having a lower surface side warp and a lower surface side weft, the upper surface side warp and lower surface side warp being arranged vertically and constituting a pair, and the upper surface side fabric and lower surface side fabric being bound with a yarn in a warp direction. The lower surface side fabric is made of a design in which either one of a warp binding yarn and a lower surface side warp constituting a pair to be woven with an upper surface side weft and a lower surface side weft passes under one lower surface side weft and then passes over a plurality of lower surface side wefts. A warp on one adjacent side of the warp has a similar design thereto and passes over and under the same lower surface side wefts. The design of a set of the two warps adjacent to each other is shifted and arranged one after another to form a complete design (or a repeating unit) of the lower surface side fabric; and a lower surface side weft has a design in which the weft passes over two successive warps and then passes under a plurality of warps to form a long crimp on the lower surface side surface.

Both of vertically arranged upper surface side warp and lower surface side warp of at least one pair may be warp binding yarns which are woven with an upper surface side weft and a lower surface side weft to form a portion of an upper surface side surface design and a portion of a lower surface side surface design. On the upper surface side surface, warp binding yarns constituting a pair may be woven with respective upper surface side wefts and cooperatively function as one warp constituting an upper surface side complete design (repeating unit).

One of warp binding yarns constituting a pair may be woven with an upper surface side weft, under which the other warp binding yarn is woven with one lower surface side weft or two non-adjacent lower surface side wefts and at the same time, the one warp binding yarn may be woven with one lower surface side weft or two non-adjacent lower surface side wefts, over which the other warp binding yarn is woven with an upper surface side weft, whereby warp binding yarns constituting a pair mutually complement to form an upper surface side warp surface design and a lower surface side warp surface design.

The industrial two-layer fabric according to the present invention is able to have improved wear resistance, surface property, rigidity, running stability and water drainage property by disposing a pair of warp binding yarns which complement an upper fabric design and a lower fabric design respectively, forming the lower surface side fabric while applying to two warps adjacent to each other the same design that they pass over and under one lower surface side weft, and forming a long crimp of a lower surface side weft on the lower surface side surface.

BRIEF DESCRIPTION OF THE DRAWINGS

FIG. 25 is a photograph of the lower surface side surface of Conventional Example 1 after the wear test.

FIG. 26 is a cross-sectional photograph taken along the weft of Conventional Example 1 after the wear test.

DETAILED DESCRIPTION OF THE INVENTION

Figure 1:
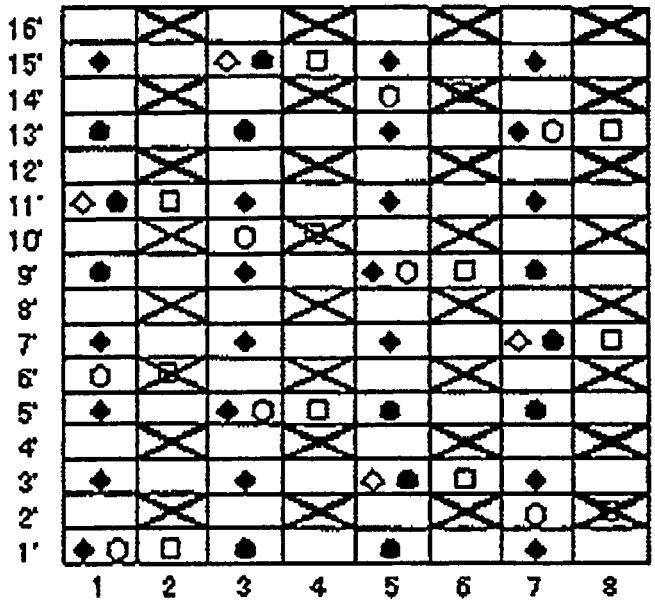
FIG. 1 is a design diagram of an industrial two-layer fabric obtained in Example 1 of the present invention.

The industrial fabric according to the present invention is an industrial two-layer fabric which comprises an upper surface side fabric having an upper surface side warp and an upper surface side weft and a lower surface side fabric having a lower surface side warp and a lower surface side weft, the upper surface side warp and lower surface side warp being arranged vertically and constituting a pair, and the upper surface side fabric and lower surface side fabric being bound with a warp direction yarn, wherein the lower surface side fabric has a complete design obtained by shifting, by several lower surface side wefts, the design of a set of two warps, that is, one warp having a design in which it passes under one lower surface side weft and then passes over a plurality of lower surface side wefts, and the other warp which is on one adjacent side to the one warp, has the same design and passes over and under the same lower surface side wefts and then arranging the design one after another; and a lower surface side weft has a design in which it passes over two successive warps, passes under a plurality of warps, thereby forming a long crimp on the lower surface side surface.

The industrial two-layer fabric according to the present invention has a pair of an upper surface side warp and a lower surface side warp arranged vertically. An upper surface side warp is woven with an upper surface side weft to form the upper surface side fabric, while a lower surface side warp is woven with a lower surface side weft to form the lower surface side fabric. As a binding yarn for weaving this upper surface side fabric and the lower surface side fabric, a warp binding yarn is employed. This warp binding yarn is not disposed especially for the purpose of weaving the upper and lower layers, but a warp binding yarn having a binding function is employed as warps of at least one pair of vertically arranged upper surface side warp and lower surface side warp.

It is preferred that one of warp binding yarns is woven with an upper surface side weft, under which the other warp binding yarn is woven with one lower surface side weft or two non-adjacent lower surface side wefts, while the one of warp binding yarns is woven with one lower surface side weft or two non-adjacent lower surface side wefts, over which the other warp binding yarn is woven with an upper surface side weft. In this manner, when two warp binding yarns forming a pair mutually complement to form an upper surface side warp surface design and a lower surface side warp surface design, there is preferably no fear of the upper surface side design and lower surface side design being destroyed.

A warp binding yarn is used under higher tension compared with a weft binding yarn so that it is effective for improving the binding power. A warp binding yarn can weave the upper and lower layers together without destroying their fabric structures so that it does not damage the surface property of the fabric. In the present invention, a warp binding yarn is not disposed singly but it is used as an upper surface side warp and a lower surface side warp constituting a pair. Two warp binding yarns constituting a pair may have the same design or different design.

An upper surface side warp is woven with an upper surface side weft to form an upper surface side fabric, while a lower surface side warp is woven with a lower surface side weft to form a lower surface side fabric. Warp binding yarns are woven with an upper surface side weft and a lower surface side weft respectively to form a portion of the upper surface side surface design and a portion of the lower surface side surface design. It is preferred that on the upper surface side surface, warp binding yarns constituting a pair are woven with respective upper surface side wefts and cooperatively function as one warp constituting the upper surface side complete design. If two warp binding yarns constituting a pair are woven with one upper surface side weft, they must be disposed in parallel, which leads to blocking of a water drainage space. A difference in water drainage property by location will be a cause of generation of marks. When a preference is given to the surface property, a warp binding yarn equal in diameter to an upper surface side warp is suited. A difference in diameter between an upper surface side warp and a warp binding yarn is not preferred, because a yarn having a greater diameter protrudes from the upper surface side surface or lower surface side surface, which may cause transfer of a wire mark to paper or wear. A relatively uniform surface can be formed when an upper surface side warp and a warp binding yarn are equal in diameter. The upper surface side warp designs formed by a pair of warp binding yarns and by an upper surface side warp may be the same or different. The upper surface side complete design may be formed by a plurality of warp complete designs. No particular limitation is imposed on the upper surface side fabric design and fabric designs such as plain weave, twill weave, broken twill weave and satin weave may be employed.

An auxiliary weft smaller in diameter than an upper surface side weft may be disposed between upper surface side wefts. For example, a fiber supporting property by wefts can be improved by employing a design in which an auxiliary weft and an upper surface side weft are disposed alternately and an auxiliary weft has a formation portion of a long crimp which passes over a plurality of warps.

In the lower surface side fabric, a warp binding yarn of a pair and a lower surface side warp pass under one lower surface side weft and then pass over a plurality of lower surface side wefts. In short, these two warps adjacent to each other form a set and pass over and under the same lower surface side wefts. Two adjacent warps constituting the lower surface side surface simultaneously weave one lower surface side weft from the lower side. The lower surface side complete design is formed by shifting the design of a set of these two warps by several lower surface side wefts and arranging the design one after another. When one warp binding yarn of a pair and a lower surface side warp are used as a set, either one of warp binding yarns may pass under the same lower surface side wefts under which the lower surface side warp passes. A lower surface side weft is designed to pass over a set of these two warps and then passes under a plurality of warps to form a long crimp on the surface side surface. Since the lower surface side weft is woven, from the lower side, by two adjacent warps, it protrudes from the backside of the fabric, leading to an increase in the wear volume. The fabric therefore has excellent wear resistance. In addition, this usually makes a warp binding yarn, which is usually smaller in diameter than a lower surface side weft, wear resistant. Moreover, the fabric has improved rigidity because a lower surface side weft is woven by two warps. The design constituting the lower surface side fabric is preferably made of an even-numbered shaft of 6 or greater and a twill weave or a broken twill weave is suited. Fabrics made of shafts not greater than 6 cannot fully exhibit the effect of the present invention because the long crimp of a lower surface side weft becomes shorter. A 4-shaft fabric or the like is therefore not preferred.

By employing the above-described structure of the present invention, not only surface property and wear resistance, but also various physical properties necessary for industrial fabrics such as rigidity, running stability and water drainage property can be attained.

Although a yarn to be used in the present invention may be selected depending on its using purpose, examples of it include, in addition to monofilaments, multifilaments, spun yarns, finished yarns subjected to crimping or bulking such as so-called textured yarn, bulky yarn and stretch yarn and yarns obtained by intertwining them. As the cross-section of the yarn, not only circular form but also square or short form such as stellar form, or elliptical or hollow form can be used. The material of the yarn can be selected freely and usable examples of it include polyester, polyamide, polyphenylene sulfide, polyvinylidene fluoride, polypropylene, aramid, polyether ether ketone, polyethylene naphthalate, polytetrafluoroethylene, cotton, wool and metal. Of course, yarns obtained using copolymers or incorporating or mixing the above-described material with a substance selected depending on the intended purpose may be used.

As upper surface side warps, lower surface side warps, warp binding yarns and upper surface side wefts of a papermaking wire, use of a polyester monofilament having rigidity and excellent dimensional stability is usually preferred. As lower surface side wefts which need wear resistance, those obtained by combined weaving of polyester monofilaments and polyamide monofilaments while arranging them alternately are preferred, because they have improved wear resistance without losing rigidity.

Although no particular limitation is imposed on the diameter of yarns constituting a fabric, it is recommended to set the diameters of upper surface side warps, warp binding yarns and lower surface side warps equal to each other. When the diameters of upper surface side warps and warp binding yarns are set equal to each other, warps of the same diameter are arranged on the upper surface side surface so that the fabric has excellent surface property. By setting the diameters of warp binding yarns and lower surface side warps equal to each other, wear of the warps appearing on the lower surface side surface can be made uniform. For example, when the diameter of lower surface side warps is made greater than that of warp binding yarns, a portion of the lower surface side warps which protrudes and appears on the lower surface side surface is worn away first because they have a greater diameter, which sometimes leads to breakage. To set the diameters of lower surface side warps and warp binding yarns equal to each other is effective for dispersing the wear to some degree and extend the life of the fabric. The diameter of upper surface side wefts is preferably made smaller than that of lower surface side wefts. In order to improve the wear resistance, the diameter of lower surface side wefts is made greater. Diameter of these yarns may be selected as needed depending on the using purpose or intended use.

EXAMPLES

Embodiments of the present invention will next be described based on some examples with reference to accompanying drawings.

Figure 2A:
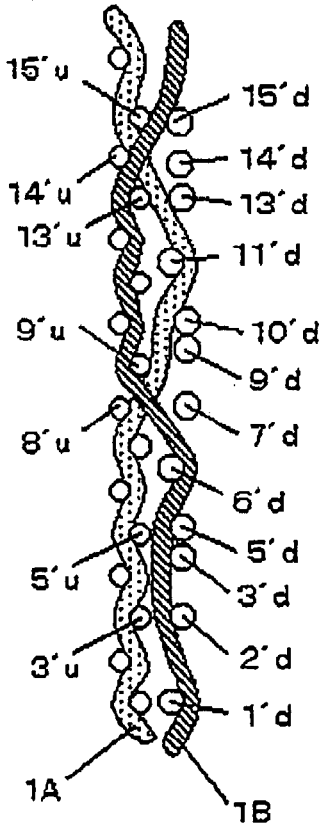
FIGS. 2A and 2B are cross-sectional views of a pair of warp binding yarns 1, and a pair of an upper surface side warp 2 and a lower surface side warp 2 of the fabric illustrated in FIG. 1.
Figure 2B:
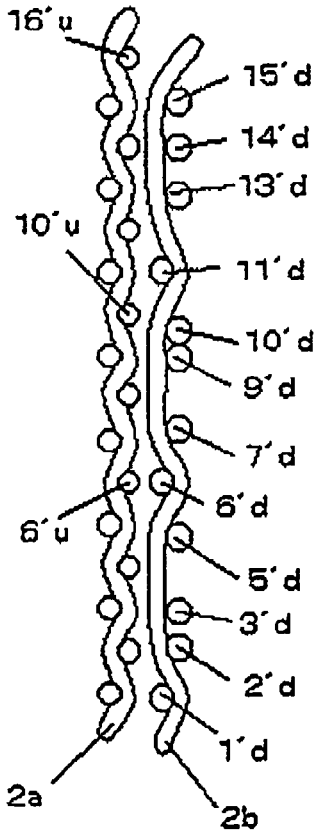
Figure 3:
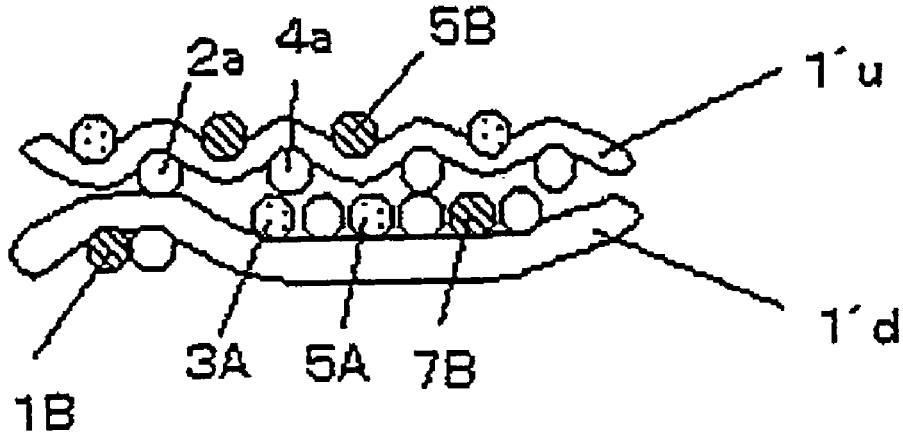
FIG. 3 is a cross-sectional view of weft 1' of FIG. 1.
Figure 5A:
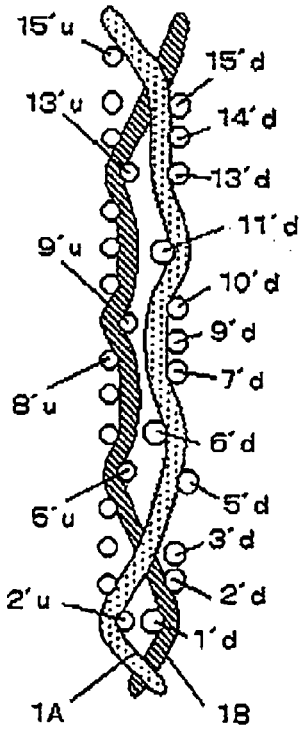
FIGS. 5A and 5B are cross-sectional views of a pair of warp binding yarns 1, and a pair of an upper surface side warp 2 and a lower surface side warp 2 of the fabric illustrated in FIG. 4.
Figure 5B:
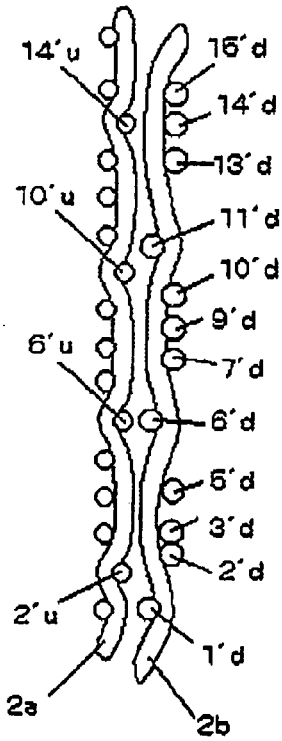
Figure 6:
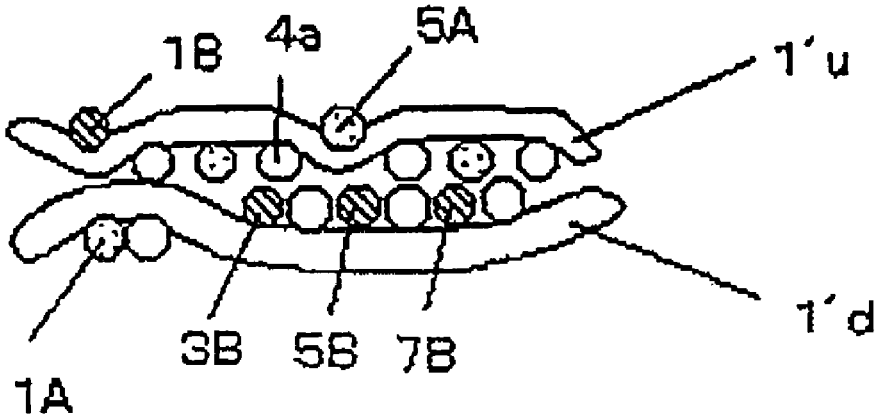
FIG. 6 is a cross-sectional view of weft 1' of FIG. 4.
Figure 8A:
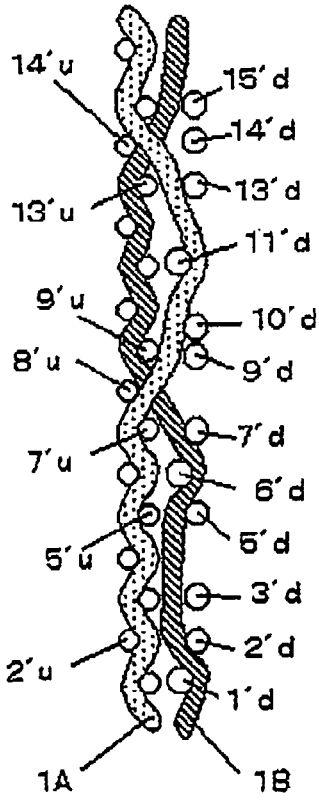
FIGS. 8A and 8B are a cross-sectional views of a pair of warp binding yarns 1, and a pair of an upper surface side warp 2 and a lower surface side warp 2 of the fabric illustrated in FIG. 7.
Figure 8B:
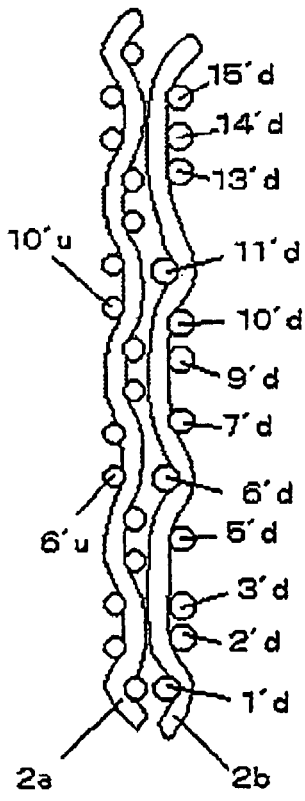
Figure 9:
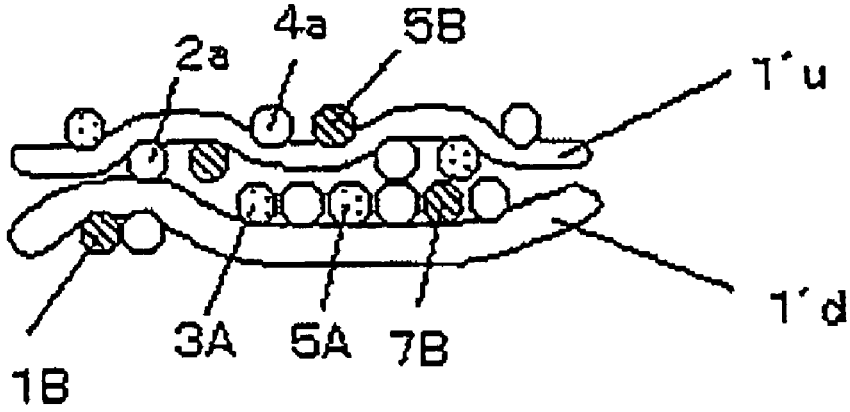
FIG. 9 is a cross-sectional view of weft 1' of FIG. 7.
Figure 11A:
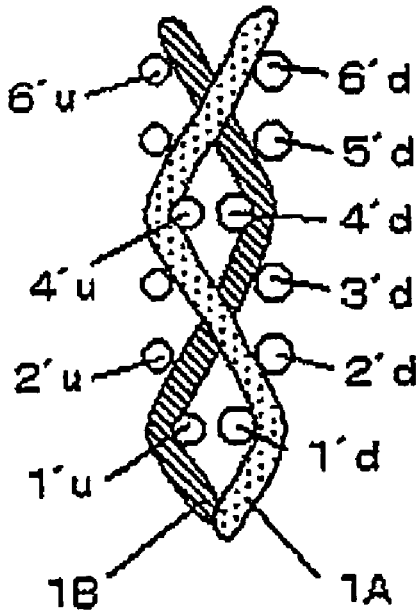
FIGS. 11A and 11B are cross-sectional views of a pair of warp binding yarns 1, and a pair of an upper surface side warp 2 and a lower surface side warp 2 of the fabric illustrated in FIG. 10.
Figure 11B:
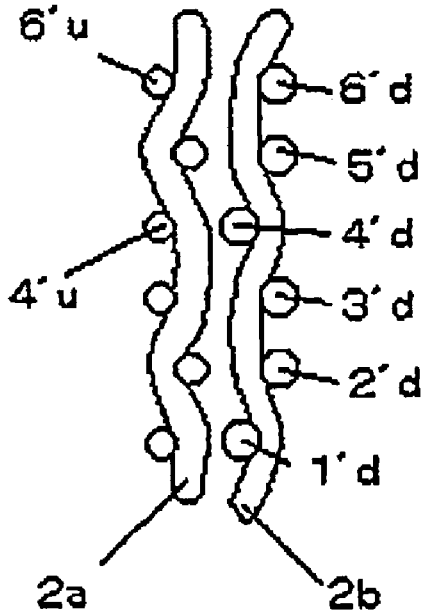
Figure 12:
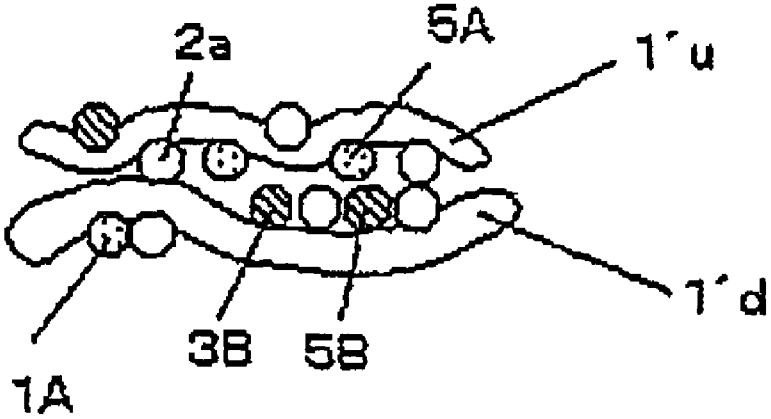
FIG. 12 is a cross-sectional view of weft 1' of FIG. 10.
Figure 14A:
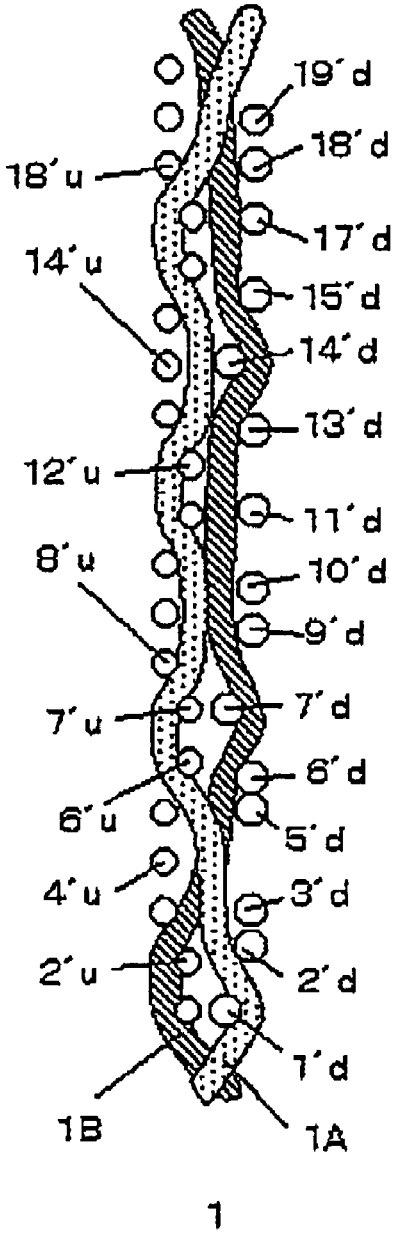
FIGS. 14A and 14B are cross-sectional views of a pair of warp binding yarns 1, and a pair of an upper surface side warp 2 and a lower surface side warp 2 of the fabric illustrated in FIG. 13.
Figure 14B:
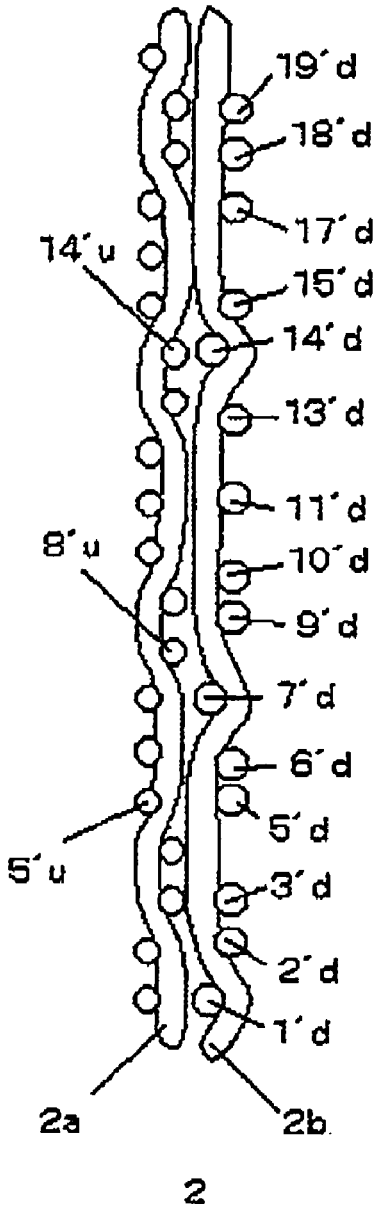
Figure 15:
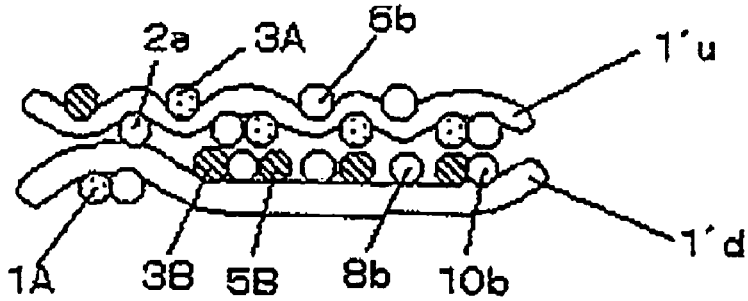
FIG. 15 is a cross-sectional view of weft 1' of FIG. 13.
Figure 17A:
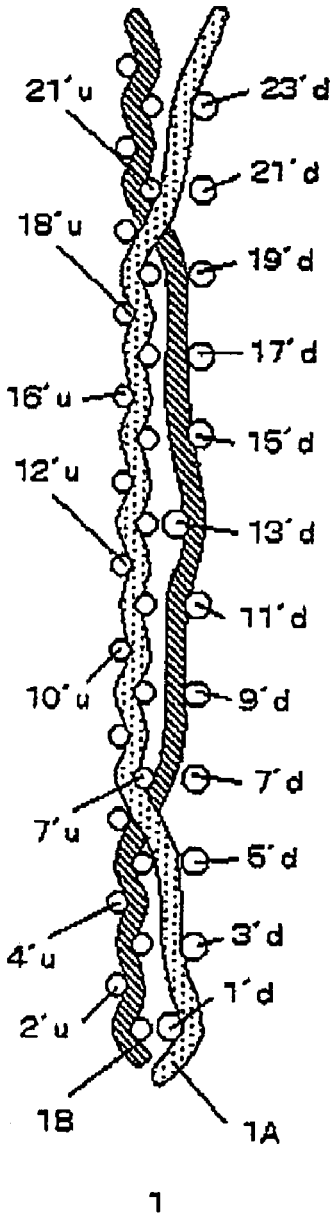
FIGS. 17A and 17B are cross-sectional views of a pair of warp binding yarns 1, and a pair of an upper surface side warp 2 and a lower surface side warp 2 of the fabric illustrated in FIG. 16.
Figure 17B:
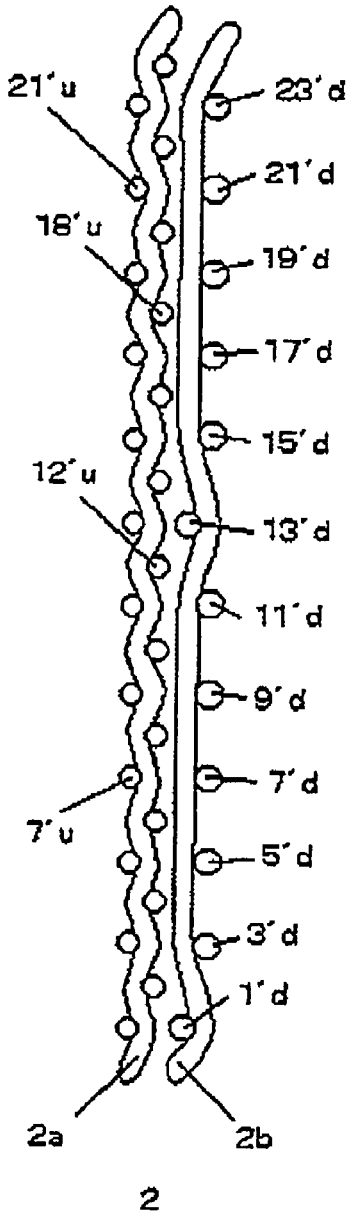
Figure 18:
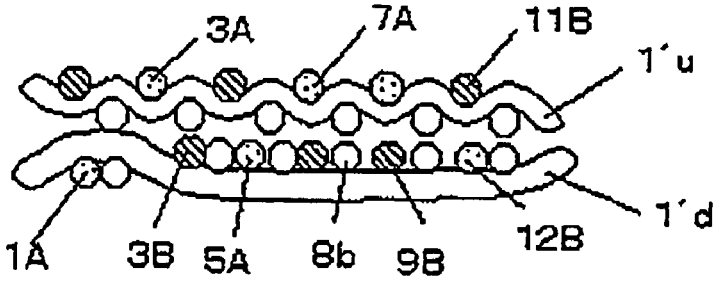
FIG. 18 is a cross-sectional view of weft 1' of FIG. 16.

FIGS. 1, 4, 7, 10, 13 and 16 are each a minimum repeating unit and this complete design is connected vertically and horizontally to form the whole design of the fabric. FIGS. 2A and 2B include two cross-sectional views of the fabric illustrated in FIG. 1: one is a view of a pair of two warp binding yarns 1A and 1B and the other is that of a pair of upper surface side warp 2*a* and lower surface side warp 2*b*. FIG. 3 is a cross-sectional view of vertically arranged upper surface side weft 1'*u* and lower surface side weft 1'*d* of the fabric illustrated in FIG. 1. FIGS. 5A and 5B include two cross-sectional views of the fabric of FIG. 4: FIG. 5A is a view of a pair of two warp binding yarns 1A and 1B and FIG. 5B is that of a pair of upper surface side warp 2*a* and lower surface side warp 2*b*. FIG. 6 is a cross-sectional view of vertically arranged upper surface side weft 1'*u* and lower surface side weft 1'*d* of the fabric illustrated in FIG. 4. FIGS. 8A and 8B includes two cross-sectional views of the fabric of FIG. 7: FIG. 8A is a view of a pair of two warp binding yarns 1A and 1B and FIG. 8B is that of a pair of upper surface side warp 2*a* and lower surface side warp 2*b*. FIG. 9 is a cross-sectional view of vertically arranged upper surface side weft 1'*u* and lower surface side weft 1'*d* of the fabric illustrated in FIG. 7. FIGS. 11A and 11B include two cross-sectional views of the fabric of FIG. 10: FIG. 11A is a view of a pair of two warp binding yarns 1A and 1B and FIG. 11B is that of a pair of upper surface side warp 2*a* and lower surface side warp 2*b*. FIG. 12 is a cross-sectional view of vertically arranged upper surface side weft 1'*u* and lower surface side weft 1'*d* of the fabric illustrated in FIG. 10. FIGS. 14A and 14B include two cross-sectional views of the fabric of FIG. 13: FIG. 14A is a view of a pair of two warp binding yarns 1A and 1B and FIG. 14B is that of a pair of upper surface side warp 2*a* and lower surface side warp 2*b*. FIG. 15 is a cross-sectional view of vertically arranged upper surface side weft 1'*u* and lower surface side weft 1'*d* of the fabric illustrated in FIG. 13. FIGS. 17A and 17B include two cross-sectional views of the fabric of FIG. 16: FIG. 17A is a view of a pair of two warp binding yarns 1A and 1B and FIG. 17B is that of a pair of upper surface side warp 2*a* and lower surface side warp 2*b*. FIG. 18 is a cross-sectional view of vertically arranged upper surface side weft 1'*u* and lower surface side weft 1'*d* of the fabric illustrated in FIG. 16.

Figure 19:
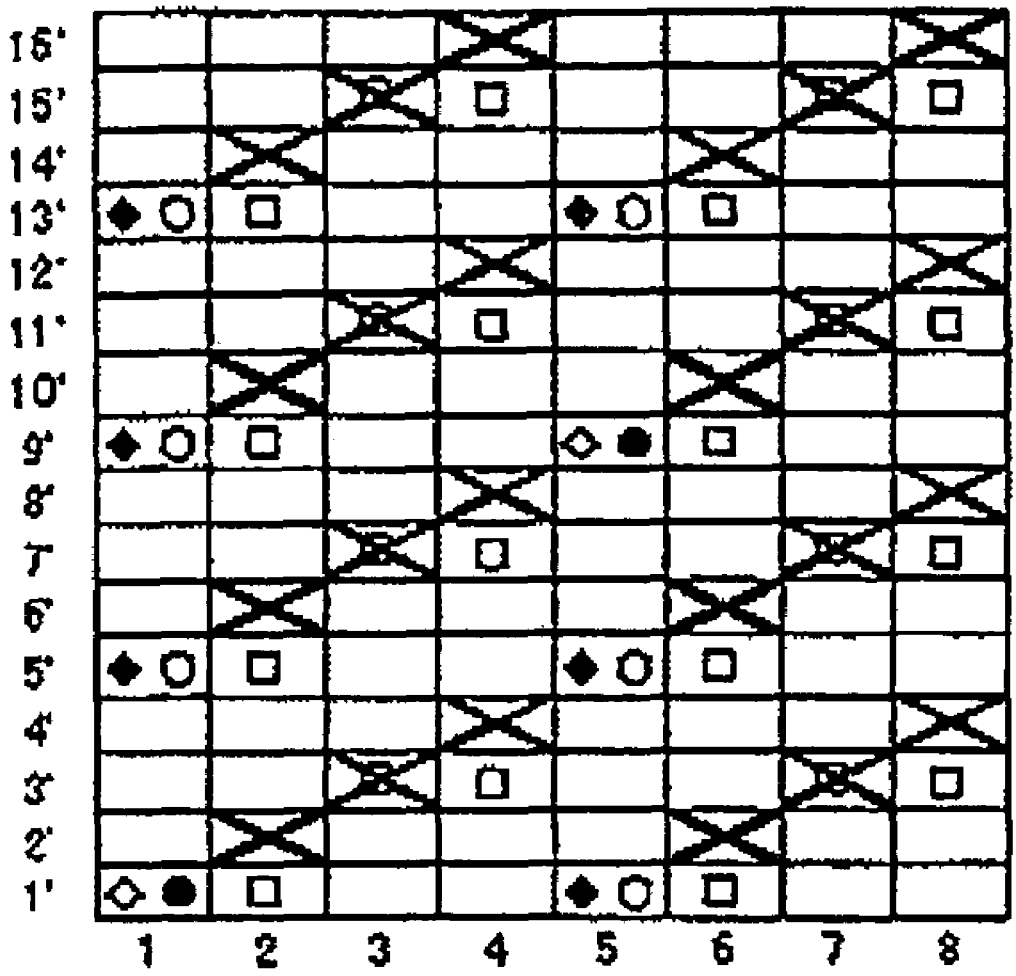
FIG. 19 is a design diagram of an industrial two-layer fabric obtained in Conventional Example 1.
Figure 20A:
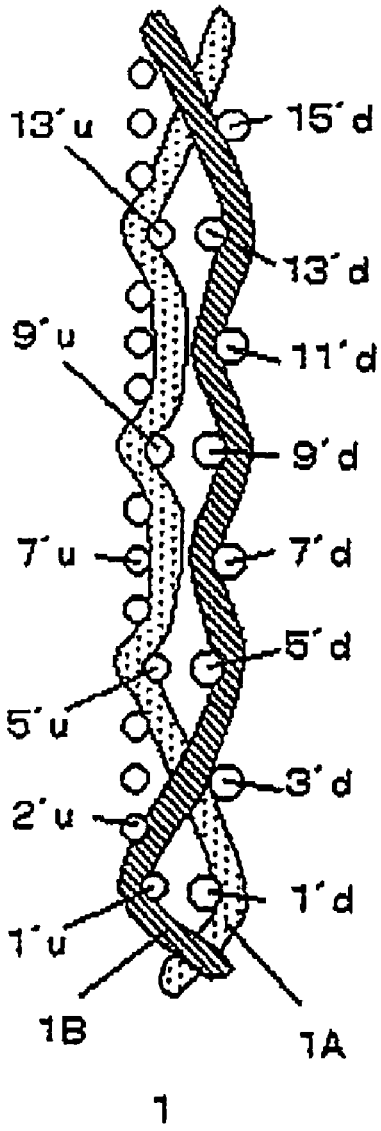
FIGS. 20A and 20B are a cross-sectional views of a pair of warp binding yarns 1, and a pair of an upper surface side warp 2 and a lower surface side warp 2 of the fabric illustrated in FIG. 19.
Figure 20B:
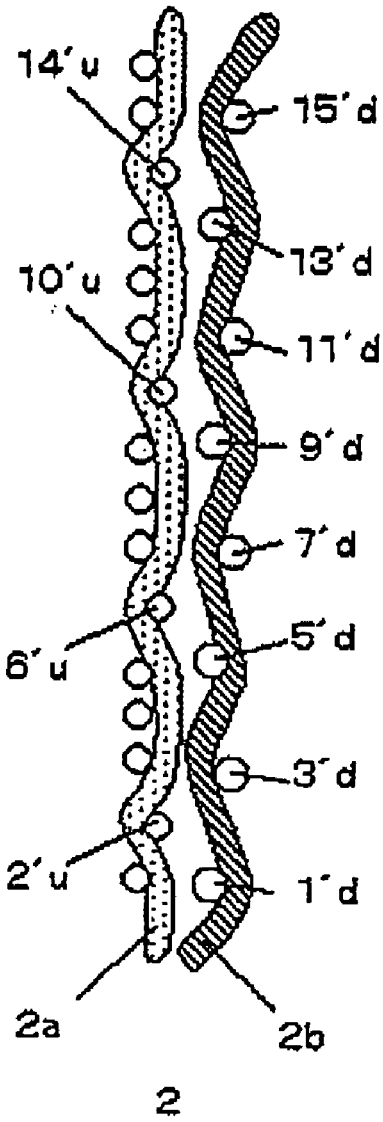
Figure 21:
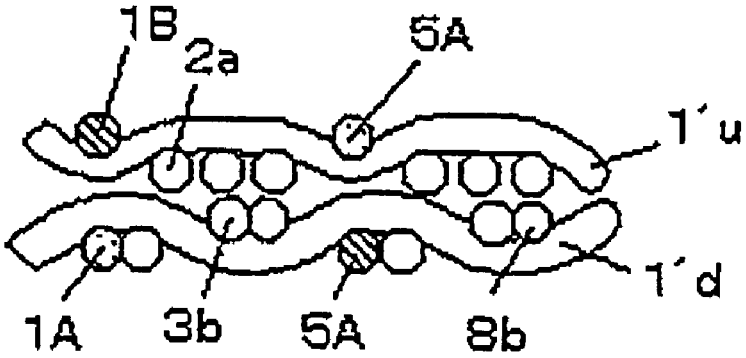
FIG. 21 is a cross-sectional view of weft 1' of FIG. 19.

FIG. 19 is a design diagram of the fabric of Conventional Example 1 in which a short crimp of a lower surface side weft is formed. FIGS. 20A and 20B include two cross-sectional views of the fabric of FIG. 19: FIG. 20A is a view of a pair of two warp binding yarns 1A and 1B and FIG. 20B is that of a pair of upper surface side warp 2*a* and lower surface side warp 2*b*. FIG. 21 is a cross-sectional view of vertically arranged upper surface side weft 1'*u* and lower surface side weft 1'*d* of the fabric illustrated in FIG. 19.

Figure 22:
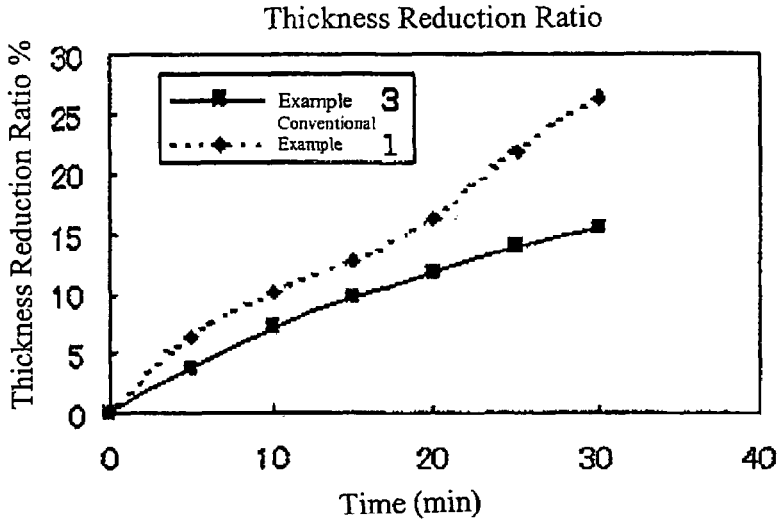
FIG. 22 is a graph of a thickness reduction ratio determined by a wear test using the fabrics of Example 2 and Conventional Example 1.
Figure 23:
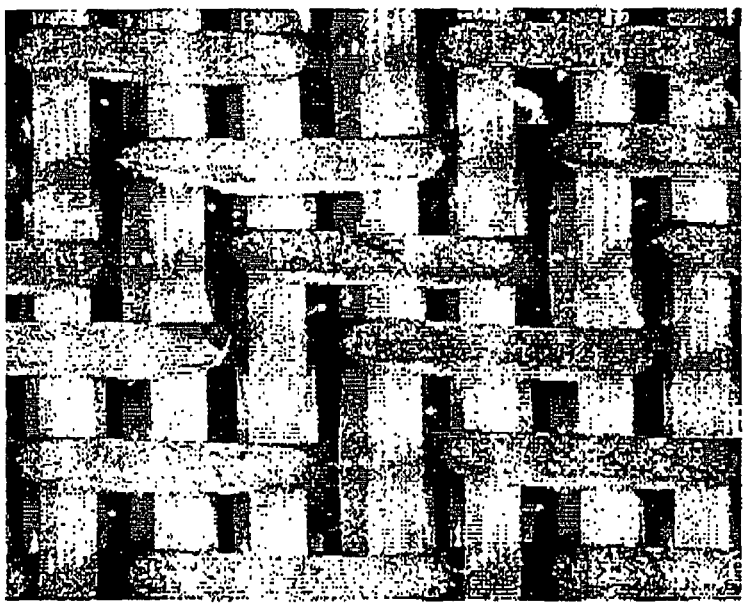
FIG. 23 is a photograph of the lower surface side surface of the fabric obtained in Example 2 after the wear test.
Figure 24:
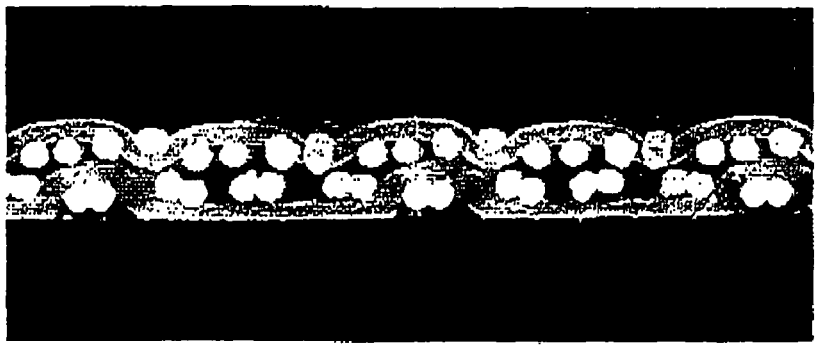
FIG. 24 is a cross-sectional photograph taken along a weft of Example 2 after wear test.

FIG. 22 is a graph of a thickness reduction ratio, which is an indicator of wear resistance, determined by a wear test using the fabrics of Example 2 and Conventional Example 1. FIG. 23 is a photograph of the lower surface side surface of the fabric obtained in Example 2 after the wear test. FIG. 24 is a cross-sectional photograph taken along a weft of Example 2 after the wear test. FIG. 25 is a photograph of the lower surface side surface of Conventional Example 1 after the wear test. FIG. 26 is a cross-sectional photograph taken along the weft of Conventional Example 1 after the wear test.

In these design diagrams, warps are indicated by Arabic numerals, for example 1, 2 and 3; upper surface side warps are indicated by numerals with a, for example, 1*a*, 2*a* and 3*a*; lower surface side warps are indicated by numerals with b, for example, 1*b*, 2*b* and 3*b*. The same numerals with a and b are regarded as a pair. Warp binding yarns are indicated by numerals with A or B, for example, 1A, 1B, 2A and 2B and the same numerals with A and B are regarded as a pair. For example, 1A and 1B constitute a pair, while 2A and 2B constitute a pair. Warp binding yarns constituting a pair appear alternately on the upper surface side and lower surface side and they cooperatively form the upper surface side surface design and the lower surface side surface design. Wefts are indicated by Arabic numerals with a prime, for example, 1', 2' and 3'. Upper surface side wefts are indicated by a numeral with u, for example, 1'*u*, 2'*u* and 3'*u*. Lower surface side wefts are indicated by a numeral with d, for example, 1'*d*, 2'*d*, and 3'*d*. Upper surface side wefts and lower surface side wefts are arranged vertically but some upper surface side wefts do not have an lower surface side weft thereunder. It depends on the arrangement ratio.

In the diagrams, a mark "x" means that an upper surface side warp lies over an upper surface side weft; a mark "□" indicates that a lower surface side warp lies under a lower surface side weft; a mark "◆" indicates that a warp binding yarn lies over an upper surface side weft; a mark "◇" indicates that the warp binding yarn lies under a lower surface side weft; a mark "●" also indicate that a warp binding yarn lies over an upper surface side weft; and a mark "○" indicates that the warp binding yarn lies under a lower surface side weft. In the cross-sectional views taken along warps and wefts, warp binding yarns of marks "◆" and "◇" are filled with dots and warp binding yarns of marks "●" and "○" are filled with slashes in order to discriminate pairs of warp binding yarns from others. In the design diagram, yarns of marks "◆" and "◇" of two warp binding yarns constituting a pair are placed on the left side and yarns of marks "●" and "○" are placed on the right side. In some cases, the right and left ones are reversed or they may be arranged alternately.

An upper surface side warp and a lower surface side warp, and an upper surface side weft and a lower surface side weft are arranged vertically. In the diagram, these yarns are vertically and precisely overlapped each other for convenience of drawings, but in the actual fabric, they may be a little misaligned each other. Two warp binding yarns constituting a pair adhere each other and on the upper surface side, function as one warp forming the upper surface side complete design. This also applies to the lower surface side fabric.

Example 1

The fabric of Example 1 is a 16-shaft two-layer fabric in which a pair of an upper surface side warp and a lower surface side warp and a pair of warp binding yarns are arranged alternately. As the upper surface side surface design, a 1/1 plain weave design is employed, while as the lower surface side surface design, a 3/1 design in which a warp passes over three lower surface side wefts and passes under one lower surface side weft is employed. Upper surface side wefts and lower surface side wefts are arranged at 4:3.

In the design diagram of FIG. 1, indicated by 1, 3, 5 and 7 are pairs of two warp binding yarns arranged vertically; indicated by 2, 4, 6 and 8 are pairs of an upper surface side warp and a lower surface side warp. Pairs of warps and pairs of warp binding yarns are arranged alternately. Upper surface side wefts and lower surface side wefts are placed at a ratio of 4:3. Upper surface side wefts 4'*u*, 8'*u*, 12'*u* and 16'*u* do not have lower surface side wefts 4'*d*, 8'*d*, 12'*d* and 16'*d* thereunder respectively. Upper surface side wefts other than them have lower surface side wefts thereunder. As is apparent from FIG. 2B, upper surface side warp 2*a* successively passes over and under one upper surface side weft, thereby forming a plain weave design on the upper surface side surface. Lower surface side warp 2*b* repeats a design in which it passes under one lower surface side weft and then passes over three successive lower surface side wefts. Described specifically, upper surface side warp 2*a* passes under upper surface side weft 1'*u*, over 2'*u*, under 3'*u*, over 4'*u*, under 5'*u*, over 6'*u*, under 7'*u*, over 8'*u*, under 9'*u*, over 10'*u*, under 11'*u*, over 12'*u*, under 13'*u*, over 14'*u*, under 15'*u* and over 16'*u*, thereby forming a 1/1 plain weave design on the upper surface side surface. On the lower surface side surface, lower surface side warp 2*b* passes under lower surface side weft 1'*d*, over three successive lower surface side wefts 2'*d*, 3'*d* and 5'*d*, under lower surface side weft 6'*d*, over three successive lower surface side wefts 7'*d*, 9'*d*, 10'*d*, under lower surface side weft 11'*d*, and over three successive lower surface side wefts 13'*d*, 14'*d* and 15'*d*, thereby repeating a 1/3 design.

As is apparent from FIG. 2A, warp binding yarn 1A which constitutes a pair of warp binding yarns 1 passes over upper surface side weft 1'*u*, under 2'*u*, over 3'*u*, under 4'*u*, over 5'*u*, under 6'*u*, over 7'*u*, between three upper surface side wefts 8'*u*, 9'*u* and 10'*u* and lower surface side wefts 9'*d* and 10'*d*, under lower surface side weft 11'*d*, between upper surface side wefts 12'*u*, 13'*u* and 14'*u* and lower surface side wefts 13'*d* and 14'*d*, over upper surface side weft 15'*u*, and under upper surface side weft 16'*u*. Warp binding yarn 1B which also constitutes the pair passes under lower surface side weft 1'*d*, between upper surface side wefts 2'*u* to 5'*u* and lower surface side wefts 2'*d*, 3'*d* and 5'*d*, under lower surface side weft 6'*d*, between upper surface side weft 7'*u* and 8'*u* and lower surface side weft 7'*d*, over upper surface side weft 9'*u*, under 10'*u*, over 11'*u*, under 12'*u*, over 13'*u*, and between upper surface side wefts 14'*u*, 15'*u* and 16'*u* and lower surface side wefts 14'*d* and 15'*d*.

In warp binding yarns which constitute a pair, one of the warp binding yarns is woven with an upper surface side weft to form an upper surface side design, while the other warp binding yarn is woven with one lower surface side weft or two non-adjacent lower surface side wefts to form a lower surface side design. In other words, in a portion where one warp binding yarn forms a lower surface side surface design, the other warp binding yarn complements the upper surface side surface design. In a portion where one warp binding yarn forms the upper surface side surface design, the other warp binding yarn complements the lower surface side surface design. Two warp binding yarns mutually complement the designs, thereby forming the upper surface side surface design and lower surface side surface design so that even if warp binding yarns travel between the upper surface side fabric and lower surface side fabric, they do not destroy the upper surface side and lower surface side surface designs and the resulting fabric is able to have excellent surface property. In this example, warp biding yarns which constitute a pair have different designs each other, but they may have the same design.

These two warp binding yarns 1A and 1B pass over upper surface side weft 1'*u*, under 2'*u*, over 3'*u*, under 4'*u*, over 5'*u*, under 6'*u*, over 7'*u*, under 8'*u*, over 9'*u*, under 10'*u*, over 11'*u*, under 12'*u*, over 13'*u*, under 14'*u*, over 15'*u*, and under 16'*u*, thereby cooperatively forming a 1/1 plain weave design on the upper surface side surface. On the lower surface side, they pass under lower surface side weft 1'*d*, over three successive 2'*d*, 3'*d* and 5'*d*, under lower surface side weft 6'*d*, over three successive 7'*d*, 9'*d* and 10'*d*, under lower surface side weft 11'*d*, and then passes over three successive 13'*d*, 14'*d* and 15'*d*, thereby forming a 3/1 design.

As is apparent from FIG. 1, the fabric of this example has, on the upper surface side surface, a plain weave design in which warp binding yarns constituting a pair and an upper surface side warp successively passes over and under one upper surface side weft in repetition. It becomes a fabric excellent in surface property and fiber supporting property, because a dense surface is formed by adopting a plain weave design for the upper surface side design. In this example, the designs formed by pairs of warp binding yarns and upper surface warp are the same so that a uniform plain weave design is formed on the upper surface side surface. The designs formed by pairs of warp binding yarns and upper surface side warp are not necessarily made the same and a plurality of warp complete designs may be employed on the upper surface side.

On the lower surface side, warp binding yarns 1 constituting a pair and lower surface side warp 2 pass under the same lower surface side wefts and form a 3/1 design. The complete design of the lower surface side fabric is formed by shifting, by three lower surface side wefts, the design of a set of two warps 1 and 2 which are adjacent to each other and form the lower surface side surface and arranging the design one after another. A set of warps 3 and 4 is arranged adjacent to the set of warps 1 and 2 by shifting the design of the set of warps 1 and 2 by three lower surface side wefts. Similarly, a set of warps 5 and 6 is arranged adjacent to the set of warps 3 and 4 and a set of warps 7 and 8 is arranged adjacent to the set of warps 5 and 6, each by shifting three lower surface side wefts, whereby a complete design is formed.

By this, a lower surface side weft is designed, as illustrated in FIG. 3, to pass over two successive warps, and passes under six warps to form a long crimp on the lower surface side surface. For example, lower surface side weft 1'*d* has a design in which it passes over two warps 1 and 2 and then passes under six warps to form a long crimp on the lower surface side surface. This also applies to the other lower surface side wefts and they have a design in which each weft passes over two successive warps and then passes under six warps to form a long crimp on the lower surface side surface. The lower surface side weft is firmly woven with two warps so that the resulting fabric has excellent rigidity and, because of a design having a long crimp of a lower surface side weft formed on the lower surface side surface, it has excellent wear resistance. The fabric obtained in this example having such a design is therefore able to have various physical properties necessary for an industrial fabric, for example, surface property, wear resistance, rigidity, fiber supporting property, and running stability.

Example 2

The fabric obtained in Example 2 is a 16-shaft two-layer fabric in which a pair of an upper surface side warp and a lower surface side warp and a pair of warp binding yarns are alternately arranged. A 1/3 twill weave design is adopted as the upper surface side surface design, while a 3/1 design is adopted as the lower surface side surface design. Upper surface side wefts and lower surface side wefts are arranged at 4:3, which is similar to Example 1.

Figure 4:
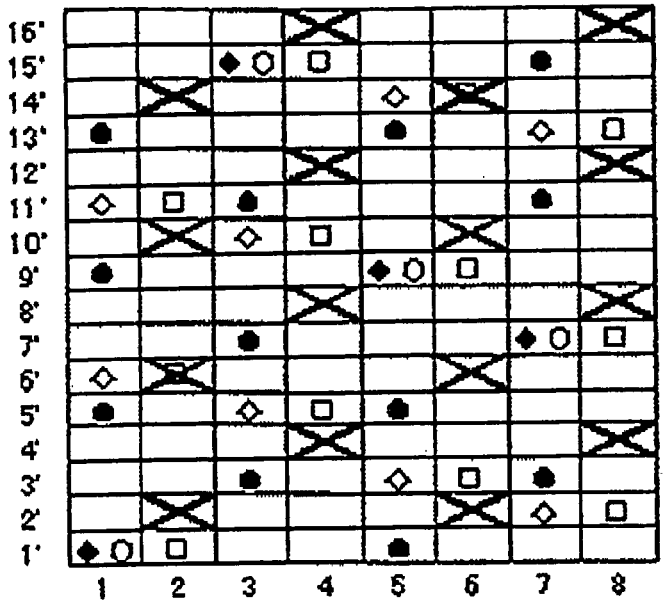
FIG. 4 is a design diagram of an industrial two-layer fabric obtained in Example 2 of the present invention.

In the design diagram of FIG. 4, indicated by numerals 1, 3, 5 and 7 are pairs of two warp binding yarns arranged vertically, and indicated by numerals 2, 4, 6 and 8 are pairs of an upper surface side warp and a lower surface side warp. Pairs of warps and pairs of warp binding yarns are arranged alternately.

The fabric of this example is different from that of Example 1 in the upper surface side surface design. Described specifically, an upper surface side warp and an upper surface side weft are interwoven to form a 1/3 design on the upper surface side surface, while two warp binding yarns constituting a pair appear on the upper surface side surface alternately to function as one warp and form a 1/3 design similar to that of an upper surface side warp. By employing a 1/3 twill weave design as the upper surface side design, the count of wefts can be increased, whereby the fabric is able to have a dense surface and is excellent in fiber supporting property by wefts.

With regards to a pair of warp binding yarns, one of the warp binding yarns is woven with an upper surface side weft to form the upper surface side design, while the other warp binding yarn is woven with one lower surface side weft or two non-adjacent lower surface side wefts to form a lower surface side design. In other words, in a portion where one of warp binding yarns forms the lower surface side surface design, the other warp binding yarn complements the upper surface side surface design, while in a portion where one of warp binding yarns form the upper surface side surface design, the other warp binding yarn complements the lower surface side surface. Two warp binding yarns form the upper surface side design and the lower surface side design, mutually complementing these designs.

The lower surface side fabric has a design similar to that of Example 1, in which a warp passes under one lower surface side weft and then passes over three lower surface side wefts. In a pair of warp binding yarns, they cooperatively function as one lower surface side warp. Warp 2 adjacent to the warp binding yarn 1 has also the same design in which it passes over and under the same lower surface side wefts. The complete design of the lower surface side fabric is formed by shifting, by three lower surface side wefts, the design of a set of two warps 1 and 2 which are adjacent to each other, and arranging the design one after another. A set of warps 3 and 4 is arranged adjacent to the set of warps 1 and 2 by shifting its design by three lower surface side wefts and similarly, a set of warps 5 and 6 is arranged adjacent to the set of warps 3 and 4 and a set of warps 7 and 8 is arranged adjacent to the set of warps 5 and 6, by shifting each design by three lower surface side wefts, whereby a complete design is formed.

By this, a lower surface side weft is designed, as illustrated in FIG. 6, to pass over two successive warps, and then pass under six warps to form a long crimp on the lower surface side surface. This also applies to the other lower surface side wefts and they have a design in which each weft passes over two successive warps and then passes under six warps to form a long crimp on the lower surface side surface. A lower surface side weft is firmly woven by two warps so that the resulting fabric has excellent rigidity and, because of a design having a long crimp of a lower surface side weft formed on the lower surface side surface, it has excellent wear resistance. The fabric obtained in this example has such a design that it can have various physical properties necessary for an industrial fabric, for example, surface property, wear resistance, rigidity, fiber supporting property, and running stability.

Example 3

The fabric obtained in Example 3 is a 16-shaft two-layer fabric in which three pairs of an upper surface side warp and a lower surface side warp are arranged relative to a pair of warp binding yarns. This fabric is formed by alternately arranging, for warps of the upper surface side design, a 1/1 plain weave design and a 2/2 level weave design and, for the lower surface side design, a 1/3 design. Upper surface side wefts and lower surface side wefts are arranged at 4:3, similar to that of Example 1.

Figure 7:
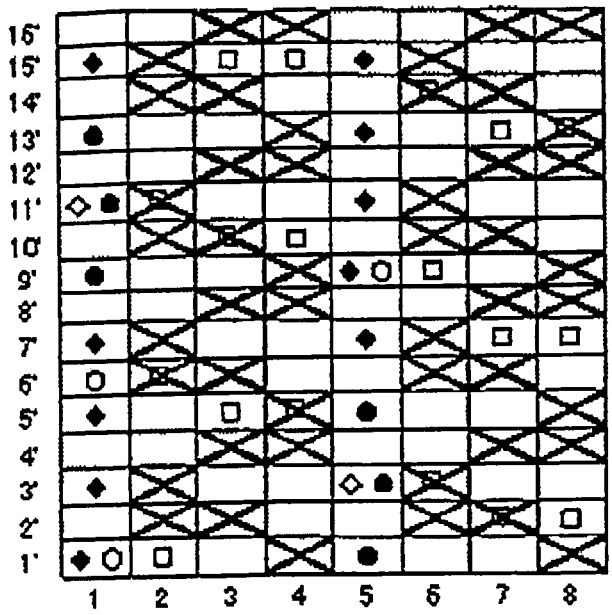
FIG. 7 is a design diagram of an industrial two-layer fabric obtained in Example 3 of the present invention.

In the design diagram of FIG. 7, indicated by numerals 1 and 5 are pairs of two warp binding yarns arranged vertically, while indicated by numerals 2, 3, 4, 6, 7, and 8 are pairs of an upper surface side warp and a lower surface side warp. The pairs of warp binding yarns and the pairs of warps are arranged at a ratio of 1:3.

Upper surface side warps are woven alternately with upper surface side wefts and some of the upper surface side warps form a 1/1 plain weave design and some form a 2/2 level weave on the upper surface side surface. A pair of warp binding yarns forms a 1/1 plain weave. Warp binding yarns constituting a pair alternately appear on the upper surface side surface, function as one warp and form a 1/1 plain weave design similar to upper surface side warps. By alternately arranging a 1/1 upper surface side warp design and a 2/2 upper surface side warp design as in this Example, the resulting fabric is able to have both rigidity, which has been attained by the 1/1 design, and water drainage property, which has been attained by the 2/2 design. The fabric may thus be obtained by employing a plurality of designs as a warp design forming the upper surface side fabric.

With regards to a pair of warp binding yarns, one of the warp binding yarns is woven with an upper surface side weft to form the upper surface side design, while the other warp binding yarn is woven with one lower surface side weft or two non-adjacent lower surface side wefts to form a lower surface side design. In other words, in a portion where one of warp binding yarns forms the lower surface side surface design, the other warp binding yarn complements the upper surface side surface design, while in a portion where one of warp binding yarns form the upper surface side surface design, the other warp binding yarn complements the lower surface side surface. Two warp binding yarns form the upper surface side design and the lower surface side design, mutually complementing these designs.

The lower surface side fabric has a design similar to that of Example 1, in which a warp passes under one lower surface side weft and then passes over three lower surface side wefts. In a pair of warp binding yarns, they cooperatively function as one lower surface side warp. Warp 2 adjacent to the warp binding-yarn 1 has also the same design in which it passes over and under the same lower surface side wefts. The complete design of the lower surface side fabric is formed by shifting, by three lower surface side wefts, the design of a set of two warps 1 and 2 which are adjacent to each other and arranging the design one after another. A set of warps 3 and 4 is arranged adjacent to the set of warps 1 and 2 by shifting the design by three lower surface side wefts and similarly, a set of warps 5 and 6 is arranged adjacent to the set of warps 3 and 4 and a set of warps 7 and 8 is arranged adjacent to the set of warps 5 and 6, each by shifting the design by three lower surface side wefts, whereby a complete design is formed.

By this, a lower surface side weft is designed, as illustrated in FIG. 9, to pass over two successive warps, and then pass under six warps to form a long crimp on the lower surface side surface. This also applies to the other lower surface side wefts and they have a design in which each weft passes over two successive warps and then passes under six warps to form a long crimp on the lower surface side surface. The lower surface side weft is firmly woven by two warps so that the resulting fabric has excellent rigidity and, because of a design having a long crimp of a lower surface side weft formed on the lower surface side surface, it has excellent wear resistance. The fabric obtained in this example having such a design is therefore able to have various physical properties necessary for an industrial fabric, for example, wear resistance, rigidity, fiber supporting property, and running stability.

Example 4

The fabric obtained in Example 4 is a 12-shaft two-layer fabric in which a pair of an upper surface side warp and a lower surface side warp and a pair of warp binding yarns are alternately arranged. This fabric is obtained by employing a 1/2 twill weave design for the upper surface side surface design and a 2/1 design for the lower surface side surface design. Upper surface side wefts and lower surface side wefts are arranged at 1:1.

Figure 10:
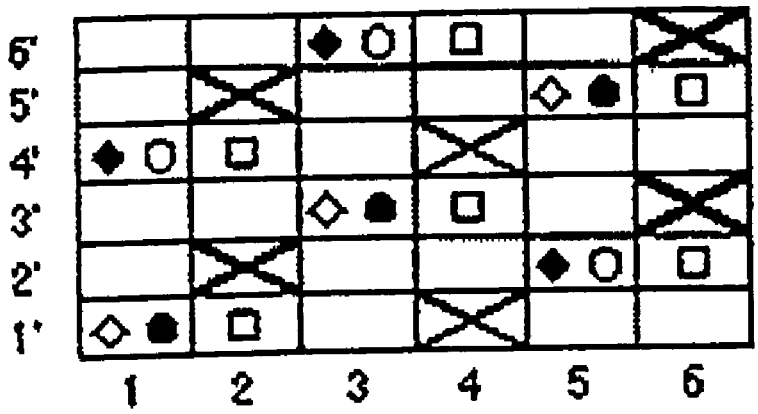
FIG. 10 is a design diagram of an industrial two-layer fabric obtained in Example 4 of the present invention.

In the design diagram of FIG. 10, indicated by numerals 1, 3, 5 are pairs of two vertically-arranged warp binding yarns, while indicated by numerals 2, 4 and 6 are pairs of an upper surface side warp and a lower surface side warp. Pairs of warp binding yarns and pairs of warps are arranged at 1:1.

Upper surface side warps are woven with upper surface side wefts to form a 1/2 twill weave design on the upper surface side surface. Warp binding yarns forming a pair alternately appear on the upper surface side surface, function as one warp and form a 1/2 design similar to that of upper surface side warps.

With regards to a pair of warp binding yarns, one of the warp binding yarns is woven with an upper surface side weft to form the upper surface side design, while the other warp binding yarn is woven with one lower surface side weft or two non-adjacent lower surface side wefts to form a lower surface side design. In other words, in a portion where one of warp binding yarns forms the lower surface side surface design, the other warp binding yarn complements the upper surface side surface design, while in a portion where one of warp binding yarns form the upper surface side surface design, the other warp binding yarn complements the lower surface side surface. Two warp binding yarns form the upper surface side design and the lower surface side design, mutually complementing these designs.

The lower surface side fabric has a design in which a warp passes under one lower surface side weft and then passes over two lower surface side wefts. In a pair of warp binding yarns, they cooperatively function as one lower surface side warp. Warp 2 adjacent to the warp binding yarn 1 has also the same design and passes over and under the same lower surface side wefts. The complete design of the lower surface side fabric is formed by shifting, by two lower surface side wefts, the design of a set of two warps 1 and 2 which are adjacent to each other and arranging the shifted design one after another. A set of two warps 3 and 4 is arranged adjacent to the set of warps 1 and 2 by shifting the design by two lower surface side wefts. Similarly, a set of warps 5 and 6 is arranged adjacent to the set of warps 3 and 4, whereby a complete design is formed.

By this, a lower surface side weft is designed, as illustrated in FIG. 12, to pass over two successive warps, and then pass under four warps to form a long crimp on the lower surface side surface. This also applies to the other lower surface side wefts and they have a design in which each weft passes over two successive warps and then passes under four warps to form a long crimp on the lower surface side surface. The lower surface side weft is firmly woven by two warps so that the resulting fabric has excellent rigidity and, because of a design having a long crimp of a lower surface side weft formed on the lower surface side surface, it has excellent wear resistance. The fabric obtained in this example having such a design is therefore able to have various physical properties necessary for an industrial fabric, for example, wear resistance, rigidity, fiber supporting property, and running stability.

Example 5

The fabric obtained in Example 5 is a 20-shaft two-layer fabric obtained by alternately arranging pairs of an upper surface side warp and a lower surface side warp and pairs of warp binding yarns. This fabric is obtained by employing a 2/3 design for the upper surface side surface design and a 4/1 design for the lower surface side surface design. Upper surface side wefts and lower surface side wefts are arranged at a ratio of 4:3 similar to that of Example 1.

Figure 13:
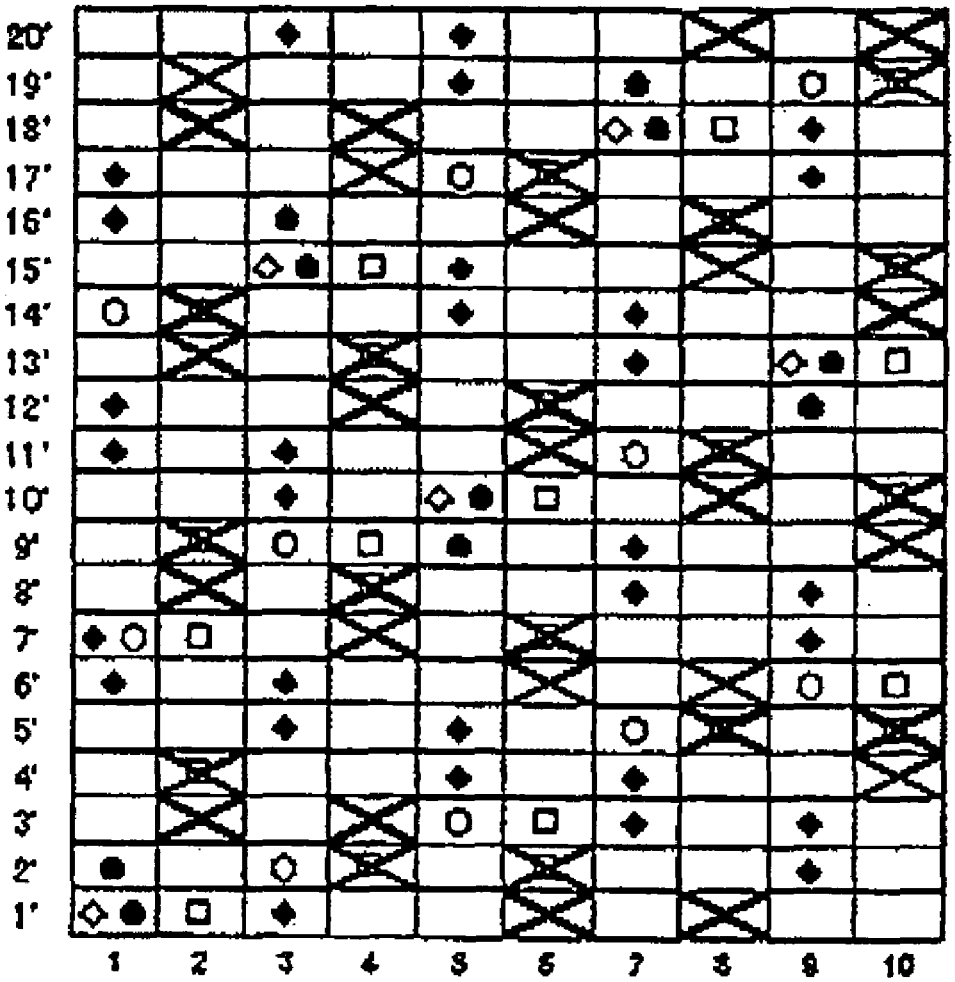
FIG. 13 is a design diagram of an industrial two-layer fabric obtained in Example 5 of the present invention.

In the design diagram of FIG. 13, indicated by numerals 1, 3, 5, 7 and 9 are pairs of two warp binding yarns arranged vertically, while indicated by numerals 2, 4, 6, 8 and 10 are pairs of an upper surface side warp and a lower surface side warp. Pairs of warps and pairs of warp binding yarns are arranged alternately.

Upper surface side warps are woven with upper surface side wefts to form a 2/3 design on the upper surface side surface. Warp binding yarns forming a pair alternately appear on the upper surface side surface, function as one warp and form a 2/3 design similar to that of upper surface side warps.

With regards to a pair of warp binding yarns, one of the warp binding yarns is woven with an upper surface side weft to form the upper surface side design, while the other warp binding yarn is woven with one lower surface side weft or two non-adjacent lower surface side wefts to form a lower surface side design. In other words, in a portion where one of warp binding yarns forms the lower surface side surface design, the other warp binding yarn complements the upper surface side surface design, while in a portion where one of warp binding yarns form the upper surface side surface design, the other warp binding yarn complements the lower surface side surface. Two warp binding yarns form the upper surface side design and the lower surface side design, mutually complementing these designs.

The lower surface side fabric has a design in which a warp passes under one lower surface side weft and then passes over four lower surface side wefts. In a pair of warp binding yarns, they cooperatively function as one lower surface side warp. Warp 2 adjacent to the warp binding yarn 1 has also the same design and passes over and under the same lower surface side wefts. The complete design of the lower surface side fabric is formed by shifting, by one lower surface side weft, the design of a set of two warps 1 and 2 which are adjacent to each other and arranging the design one after another. A set of warps 3 and 4 is arranged adjacent to the set of warps 1 and 2 by shifting the design by one lower surface side weft and similarly, a set of warps 5 and 6, a set of warps 7 and 8, and a set of 9 and 10 are arranged one after another, whereby a complete design is formed.

By this, a lower surface side weft is designed, as illustrated in FIG. 15, to pass over two successive warps, and pass under eight warps to form a long crimp on the lower surface side surface. This also applies to the other lower surface side wefts and they have a design in which each weft passes over two successive warps and then passes under eight warps to form a long crimp on the lower surface side surface. The lower surface side weft is firmly woven by two warps so that the resulting fabric has excellent rigidity and, because of a design having a long crimp of a lower surface side weft formed on the lower surface side surface, it has excellent wear resistance. The fabric obtained in this example having such a design is therefore able to have various physical properties necessary for an industrial fabric, for example, surface property, wear resistance, rigidity, fiber supporting property, and running stability.

Example 6

The fabric obtained in Example 6 is a 24-shaft two-layer fabric obtained by alternately arranging pairs of an upper surface side warp and a lower surface side warp and pairs of warp binding yarns. This fabric is obtained by employing a 1/1 plain weave design for the upper surface side surface design and a 5/1 design for the lower surface side surface design. Upper surface side wefts and lower surface side wefts are arranged at a ratio of 2:1.

Figure 16:
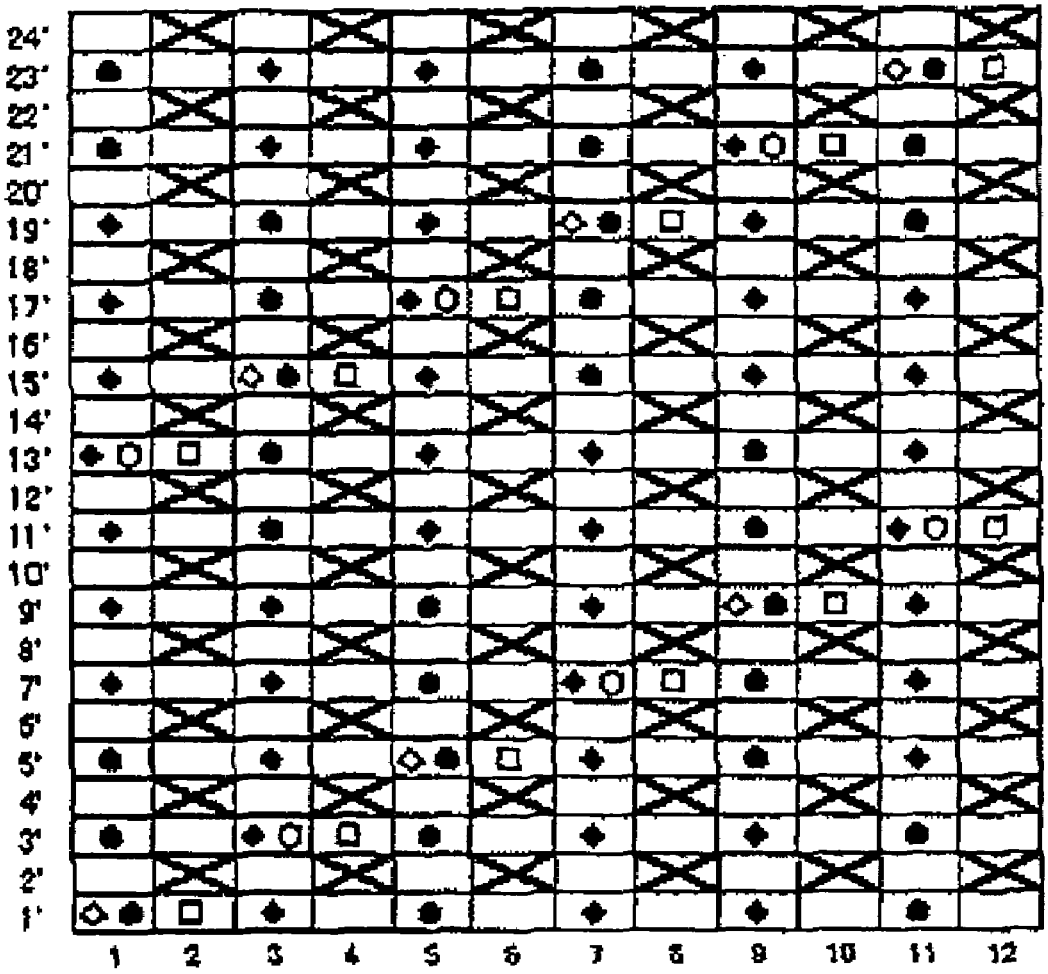
FIG. 16 is a design diagram of an industrial two-layer fabric obtained in Example 6 of the present invention.

In the design diagram of FIG. 16, indicated by numerals 1, 3, 5, 7, 9 and 11 are pairs of two warp binding yarns arranged vertically, while indicated by numerals 2, 4, 6, 8, 10 and 12 are pairs of an upper surface side warp and a lower surface side warp. Pairs of warps and pairs of warp binding yarns are arranged alternately.

Upper surface side warps are woven with upper surface side wefts to form a 1/1 plain weave design on the upper surface side surface. Warp binding yarns forming a pair appear alternately on the upper surface side surface, function as one warp and form a 1/1 plain weave design similar to that of upper surface side warps.

With regards to a pair of warp binding yarns, one of the warp binding yarns is woven with an upper surface side weft to form the upper surface side design, while the other warp binding yarn is woven with one lower surface side weft or two non-adjacent lower surface side wefts to form a lower surface side design. In other words, in a portion where one of warp binding yarns forms the lower surface side surface design, the other warp binding yarn complements the upper surface side surface design, while in a portion where one of warp binding yarns form the upper surface side surface design, the other warp binding yarn complements the lower surface side surface. Two warp binding yarns form the upper surface side design and the lower surface side design, mutually complementing these designs.

The lower surface side fabric has a design in which a warp passes under one lower surface side weft and then passes over five lower surface side wefts. In a pair of warp binding yarns, they cooperatively function as one lower surface side warp. Warp 2 adjacent to the warp binding yarn 1 has also the same design and passes over and under the same lower surface side wefts. The complete design of the lower surface side fabric is formed by shifting, by one lower surface side weft, the design of a set of two warps 1 and 2 which are adjacent to each other. A set of warps 3 and 4 is arranged adjacent to the set of warps 1 and 2 by shifting the design by one lower surface side weft. Similarly, a set of warps 5 and 6, a set of warps 7 and 8, a set of 9 and 10 and a set of 11 and 12 are arranged one after another, whereby a complete design is formed.

By this, a lower surface side weft is designed, as illustrated in FIG. 18, to pass over two successive warps, and then pass under ten warps to form a long crimp on the lower surface side surface. This also applies to the other lower surface side wefts and they have a design in which each weft passes over two successive warps and then passes under ten warps to form a long crimp on the lower surface side surface. A lower surface side weft is firmly woven by two warps so that the resulting fabric has excellent rigidity and, because of a design having a long crimp of a lower surface side weft formed on the lower surface side surface, it has excellent wear resistance. The fabric obtained in this example having such a design is therefore able to have various physical properties necessary for an industrial fabric, for example, surface property, wear resistance, rigidity, fiber supporting property, and running stability.

Conventional Example 1

FIG. 19 illustrates the complete design of the fabric obtained in Conventional Example 1. The fabric is a 16-shaft two-layer fabric in which pairs of an upper surface side warp and a lower surface side warp and pairs of warp binding yarns are arranged at a ratio of 3:1. It has a 1/3 design as an upper surface side surface design and a 1/1 design as a lower surface side surface design. Upper surface side wefts and lower surface side wefts are arranged at a ratio of 2:1. In this conventional example, the upper surface side surface has a 1/3 twill weave design in which a warp passes over one upper surface side weft and then passes under three upper surface side wefts, while the lower surface side surface has a ribbed weave design. Two adjacent warps on the lower surface side pass over and under the same wefts to form a plain weave design. The upper surface side surface design and lower surface side surface design are not destroyed because warp binding yarns constituting a pair mutually complement them each other. A difference between the fabric of this example and that of the example of the present invention resides in that as is apparent from FIG. 21, lower surface side wefts pass over two warps and then pass under two warps. This design is inferior in wear resistance because a lower surface side weft forms a short crimp on the lower surface side surface. "Wear Resistance Comparison Test"

Wear resistance comparison test was carried out using the fabric obtained in Example 2 of the present invention and that obtained in Conventional Example 1. In order to compare the wear resistance between the fabrics different in the crimp length of a lower surface side weft, the diameter of the lower surface side weft, and material and count of these fabrics were made equal.

Upper surface side warp, lower surface side warp, warp binding yarn: 0.17 mm (PET)

Upper surface side weft: 0.17 mm (PET)

Lower surface side weft: 0.22 mm (PET)

Count: 95

The fabric of Example 2 had a design in which a lower surface side weft passes over two warps and then passes under six warps to form, on the lower surface side surface, a long crimp corresponding to six warps, while that of Conventional Example 1 had a design in which a lower surface side weft passes over two warps, and then passes under two warps to form, on the lower surface side surface, a short crimp corresponding to two warps.

Wear resistance test was carried out on the assumption of paper manufacture by extending each fabric sample on a rotating ceramic roll under a predetermined tension, feeding a predetermined amount of a 2% slurry of calcium carbonate onto the fabric which was rotating while being in contact with the roll, calculating a thickness reduction ratio based on the thickness reduction amounts measured at 5-minute intervals for 30 minutes, and observing the wear of the lower surface side weft brought into contact with the roll surface.

FIG. 22 is a graph showing a thickness reduction ratio; FIG. 23 is a photograph of the lower surface side surface of the fabric obtained in the present example after completion of the test; FIG. 24 is a cross-sectional photograph taken along a weft after completion of the test; FIG. 25 is a photograph of the lower surface side surface of the fabric obtained in the conventional example after completion of the test; and FIG. 26 is a cross-sectional photograph taken along a weft after completion of the test.

As is apparent from FIG. 22, a thickness reduction ratio is higher and a slope is steeper in Conventional Example 1 than Example 2. The difference of the graph becomes eminent with the passage of time. This owes to a difference in the length of crimp of the lower surface side weft. This graph shows that wear of the lower surface side weft is dispersed and therefore smaller when the fabric has a long crimp of a lower surface side weft as in the example of the present invention. As is apparent from the comparison between the photograph of the lower surface side surface of Example 2 in FIG. 23 and that of the conventional example in FIG. 25, some warps constituting the lower surface side are broken and the wear is severer in the fabric of the conventional example after 30 minutes. On the other hand, warps in the fabric of Example 2 are not worn away because the long crimp of a weft protects them from wear. As the cross-sectional view of FIG. 24 taken along a weft indicates, it takes time until the warp is worn away. The above-described results have revealed that the fabric having a long crimp of a lower surface side weft formed therein is superior in wear resistance to that of the conventional example having a short crimp of a lower surface side weft formed therein.

The fabrics according to the present invention do not easily transfer wire marks of fabrics to paper, have enough wear resistance and rigidity to permit preferable use under severe environments, and in addition have fiber supporting property, improved papermaking yield, good water drainage property, dimensional stability and running stability. Even in a papermaking wire which must satisfy severe requirements, the fabrics of the present invention can be used for a prolonged period until the final using stage while maintaining the conditions necessary for the manufacture of good paper.

Although only some exemplary embodiments of this invention have been described in detail above, those skilled in the art will readily appreciated that many modifications are possible in the exemplary embodiments without materially departing from the novel teachings and advantages of this invention. Accordingly, all such modifications are intended to be included within the scope of this invention.

What is claimed is:

1. An industrial two-layer fabric comprising:

an upper surface side fabric having an upper surface side warp and an upper surface side weft; and a lower surface side fabric having a lower surface side warp and a lower surface side weft, the upper surface side warp and lower surface side warp being arranged vertically and constituting a pair, and the upper surface side fabric and lower surface side fabric being bound with a yarn in a warp direction, wherein:

the lower surface side fabric is made of a first design in which either one of a first warp binding yarn and a second warp binding yarn constituting a pair to be woven with an upper surface side weft and a lower surface side weft, passes under one lower surface side weft and then passes over a plurality of lower surface side wefts;

the lower surface side warp adjacent to the one of the first and second warp binding yarns passes over and under the same lower surface side wefts over and under which the one of the first and second warp binding yarns passes;

the first design of a set of the lower surface side warp and the one of the first and second warp binding yarns which are adjacent to each other, is shifted with respect to another different set of two warps adjacent to each other, and the sets being arranged sequentially to form a complete design of the lower surface side fabric; and a lower surface side weft has a second design in which the weft passes over two successive warps and then passes under a plurality of warps to form a long crimp on the lower surface side surface.

2. An industrial two-layer fabric according to claim 1, wherein both of vertically arranged upper surface side warp and lower surface side warp of at least one pair are warp binding yarns which are woven with an upper surface side weft and a lower surface side weft to form a portion of an upper surface side surface design and a portion of a lower surface side surface design; and on the upper surface side surface, warp binding yarns constituting a pair are woven with respective upper surface side wefts and cooperatively function as one warp constituting an upper surface side complete design.

3. An industrial two-layer fabric, wherein one of warp binding yarns constituting a pair as claimed in claim 2 is woven with an upper surface side weft, under which the other warp binding yarn is woven with one lower surface side weft or two non-adjacent lower surface side wefts and at the same time, the one warp binding yarn is woven with one lower surface side weft or two non-adjacent lower surface side wefts, over which the other warp binding yarn is woven with an upper surface side weft, whereby warp binding yarns constituting a pair mutually complement to form an upper surface side warp surface design and a lower surface side warp surface design.

4. An industrial two-layer fabric according to any one of claims 1 to 3, wherein one warp of a set of two warps which have the same design and pass over and under one lower surface side weft is a warp binding yarn which complements the upper and lower fabric designs and constitute the fabric designs, while the other one is a lower surface side warp constituting a pair with an upper surface side warp.

5. An industrial two-layer fabric according to any one of claims 1 to 3, wherein an upper surface side weft and an auxiliary weft having a smaller diameter than the upper surface side weft are arranged alternately on the upper surface side and the auxiliary weft has a design having a formation portion of a long crimp passing over a plurality of warps.

6. An industrial two-layer fabric according to any one of claims 1 to 3, wherein the design forming the lower surface side fabric is an even-numbered shaft of 6 or greater and is either one of a twill weave or a broken twill weave.

7. An industrial two-layer fabric according to any one of claims 1 to 3, wherein an upper surface side warp, a lower surface side warp and a warp binding yarn are equal in diameter.

8. An industrial two-layer fabric which comprises an upper surface side fabric having an upper surface side warp and an upper surface side weft and a lower surface side fabric having a lower surface side warp and a lower surface side weft, the upper surface side warp and lower surface side warp being arranged vertically and constituting a pair, and the upper surface side fabric and lower surface side fabric being bound with a yarn in a warp direction, wherein:

the lower surface side fabric is made of a design in which either one of a warp binding yarn and a lower surface side warp constituting a pair to be woven with an upper surface side weft and a lower surface side weft passes under one lower surface side weft and then passes over a plurality of lower surface side wefts; a warp on one adjacent side of the warp has a similar design thereto and passes over and under the same lower surface side wefts; the design of a set of the two warps adjacent to each other is shifted and arranged one after another to form a complete design of the lower surface side fabric; and a lower surface side weft has a design in which the weft passes over two successive warps and then passes under a plurality of warps to form a long crimp on the lower surface side surface;

wherein both of vertically arranged upper surface side warp and lower surface side warp of at least one pair are warp binding yarns which are woven with an upper surface side weft and a lower surface side weft to form a portion of an upper surface side surface design and a portion of a lower surface side surface design; and on the upper surface side surface, warp binding yarns constituting a pair are woven with respective upper surface side wefts and cooperatively function as one warp constituting an upper surface side complete design.

9. An industrial two-layer fabric, wherein one of warp binding yarns constituting a pair as claimed in claim 8 is woven with an upper surface side weft, under which the other warp binding yarn is woven with one lower surface side weft or two non-adjacent lower surface side wefts and at the same time, the one warp binding yarn is woven with one lower surface side weft or two non-adjacent lower surface side wefts, over which the other warp binding yarn is woven with an upper surface side weft, whereby warp binding yarns constituting a pair mutually complement to form an upper surface side warp surface design and a lower surface side warp surface design.

10. An industrial two-layer fabric according to either claim 8 or 9, wherein one warp of a set of two warps which have the same design and pass over and under one lower surface side weft is a warp binding yarn which complements the upper and lower fabric designs and constitute the fabric designs, while the other one is a lower surface side warp constituting a pair with an upper surface side warp.

11. An industrial two-layer fabric according to either claim 8 or 9, wherein an upper surface side weft and an auxiliary weft having a smaller diameter than the upper surface side weft are arranged alternately on the upper surface side and the auxiliary weft has a design having a formation portion of a long crimp passing over a plurality of warps.

12. An industrial two-layer fabric according to either claim 8 or 9, wherein the design forming the lower surface side fabric is an even-numbered shaft of 6 or greater and is either one of a twill weave or a broken twill weave.

13. An industrial two-layer fabric according to either claim 8 or 9, wherein an upper surface side warp, a lower surface side warp and a warp binding yarn are equal in diameter.

14. An industrial two-layer fabric comprising:

an upper surface side fabric having an upper surface side warp and an upper surface side weft; and a lower surface side fabric having first and second lower surface side warps which are adjacent to each other, and a lower surface side weft, the upper surface side warp and lower surface side warp being arranged vertically and constituting a pair, and the upper surface side fabric and lower surface side fabric being bound with a yarn in a warp direction, wherein;

the lower surface side fabric is made of a first design in which the first and second lower surface side warps which are adjacent to each other, pass under one same lower surface side weft and then pass over a same plurality of lower surface side wefts;

the first design of a set of the first and second lower surface side warps is shifted with respect to another different set of two warps adjacent to each other, and the sets being arranged to form a complete design of the lower surface side fabric; and a lower surface side weft has a second design in which the weft passes over two successive warps and then passes under a plurality of warps to form a long crimp on the lower surface side surface.

* * * * *